US006352598B1

(12) United States Patent
Hisamura et al.

(10) Patent No.: US 6,352,598 B1
(45) Date of Patent: Mar. 5, 2002

(54) RARE-EARTH ALLOY POWDER PRESSING APPARATUS AND RARE-EARTH ALLOY POWDER PRESSING METHOD

(75) Inventors: Tsuyoshi Hisamura, Itami; Tsutomu Harada, Settsu; Shuichi Okuyama, Hyogo-ken, all of (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/567,987

(22) Filed: May 10, 2000

(30) Foreign Application Priority Data

May 11, 1999 (JP) ..... 11-129683

(51) Int. Cl.[7] ..... H01F 41/02
(52) U.S. Cl. ..... 148/108; 425/78
(58) Field of Search ..... 419/38; 425/78; 148/108

(56) References Cited

FOREIGN PATENT DOCUMENTS

| | | |
|---|---|---|
| JP | 59-93802 | 5/1984 |
| JP | 61-140125 | 6/1986 |
| JP | 4-112504 | 4/1992 |

OTHER PUBLICATIONS

Notification of Reasons for Refusal to the corresponding Japanese Patent Application No. 2000–135980 (and translation thereof.) Dispatch No. 004614.

*Primary Examiner*—Daniel J. Jenkins
(74) *Attorney, Agent, or Firm*—Armstrong, Westerman, Hattori, McLeland & Naughton, LLP.

(57) ABSTRACT

A rare-earth alloy powder pressing apparatus comprises a die. The die includes a die main body. The die main body includes a through hole for formation of a cavity, and an auxiliary yoke. A rare-earth alloy powder is fed into the cavity. A correcting yoke is disposed near the die, on a side from which a compact is taken out, and an orienting magnetic field is applied. At this time, the correcting yoke is disposed on an upper side of the die if the compact is to be taken out from the upper side of the die whereas the correcting yoke is disposed on a lower side of the die if the compact is to be taken out from the lower side of the die, an inward side surface of the correcting yoke and an inward side surface of the auxiliary yoke are made flush with a plane vertical to a direction in which the orienting magnetic field is applied, and the correcting yoke is urged toward the die. Then, the rare-earth alloy powder is pressed by an upper punch and a lower punch to form a compact. The correcting yoke and the auxiliary yoke may be made integrally with each other.

18 Claims, 14 Drawing Sheets

Amount of distortion=H−h

RARE-EARTH ALLOY POWDER PRESSING APPARATUS AND RARE-EARTH ALLOY POWDER PRESSING METHOD

BACKGROUND OF THE INVENTION

1. Field of the Invention

The present invention relates to a rare-earth alloy powder pressing apparatus and a rare-earth alloy powder pressing method, and more specifically to a rare-earth alloy powder pressing apparatus and a rare-earth alloy powder pressing method for example in which the rare-earth alloy powder fed in a cavity of a through hole of a die is pressed to form a compact.

2. Description of the Related Art

Referring to FIG. 12, a conventional rare-earth alloy powder pressing apparatus 1 comprises a frame 2 like a cage made of a magnetic material. Within the frame 2, a pair of pole pieces 4 for gathering a magnetic flux toward a cavity 3 is disposed. Each of the pole pieces 4 is surrounded by a coil 5 for generating a magnetic field, and a die 6 is disposed between the pole pieces 4. The die 6 includes a through hole 6*a* formed vertically, and auxiliary yokes 6*b* formed to flank the through hole 6*a*. The magnetic flux from the pole pieces 4 is concentrated by the auxiliary yokes 6*b* onto the cavity 3 for increased orientation of the alloy powder in the cavity 3. An upper punch 7*a* to be inserted into the through hole 6*a* from above is disposed above the die 6, whereas a lower punch 7*b* movable relatively to the die 6 is inserted in the through hole 6*a*. The cavity 3 formed by the through hole 6*a* and the lower punch 7*b* is supplied with the rare-earth alloy powder from a feeder box 8, and the rare-earth alloy powder in the cavity 3 is oriented by the magnetic field generated by electricity applied to the coils 5.

However, in manufacture of the rare-earth magnet by the rare-earth alloy powder pressing apparatus 1, if the powder is made by a quenching method, the compact strength is decreased since grain size distribution of the powder concentrates in a narrow range. If the powder is added with a lubricant for improved compression and orientation, then the compact strength is decreased. As a result, the obtained compact is soft and brittle, having a low compact density of 3.9 g/cm$^3$~4.6 g/cm$^3$ for example. Therefore, when the compact is taken out of the die 6, the compact collapses if rubbed against walls of the through hole 6*a* over a long distance. To avoid this, the alloy powder is pressed at a shallow depth from an upper surface of the die 6.

Further, the auxiliary yokes 6*b* are disposed near the cavity 3 for increased orientation at the time of pressing. However, generally, the auxiliary yokes 6*b* are formed not to project out of the upper surface of the die 6 since the feeder box 8 slides on the upper surface of the die 6. Therefore, as shown in FIG. 13, a magnetic flux A becomes asymmetric in a vertical direction of the cavity 3 due to leakage of the magnetic flux above the cavity 3. Further, the orienting magnetic field becomes weaker in an upper portion of the cavity 3 than in the other portion thereof, having a weaker magnetic flux density. Thus, the alloy powder in the cavity 3 is drawn more strongly to the other portion, and as a result, green density after the pressing operation becomes lower in the upper portion of the cavity 3. If this compact is sintered, the sintered body 9 often becomes bent as shown in FIG. 14, due to uneven shrinkage at the time of sintering. This problem is especially serious in a product which is narrow and long in the direction of the orientation since difference in shrinkage after the sintering is significantly larger, resulting in an unacceptable bending and therefore decreased yield of the product.

SUMMARY OF THE INVENTION

It is therefore a primary object of the present invention to provide a rare-earth alloy powder pressing apparatus and a rare-earth alloy powder pressing method capable of reducing the bending in the obtained sintered body.

According to an aspect of the present invention, there is provided a rare-earth alloy powder pressing apparatus for manufacture of a compact by pressing a rare-earth alloy powder fed in a cavity of a through hole of a die, comprising: a first punch and a second punch for pressing the rare-earth alloy powder fed in the cavity; and a correcting yoke disposed near the die at a time of orientation, on a side from which the compact is taken out, for correction of a magnetic field in the cavity closer to a symmetry in a direction vertical to a direction of an orienting magnetic field.

According to another aspect of the present invention, there is provided a rare-earth alloy powder pressing method for manufacture of a compact by pressing a rare-earth alloy powder fed in a cavity of a through hole of a die, the method comprising: a first step of feeding the rare-earth alloy powder in the cavity; and a second step of orienting the rare-earth alloy powder, with a correcting yoke disposed near the die, on a side from which the compact is taken out.

According to another aspect of the present invention, a rare-earth magnet obtained by sintering a compact manufactured by the above method is provided.

According to the present invention, at the time of orientation, the correcting yoke is disposed near the die, on the side from which the compact is taken out. Therefore, when the cavity is fed with the rare-earth alloy powder and the orienting magnetic field is applied, intensity distribution of the magnetic field in the cavity becomes generally symmetric in the direction vertical to the direction in which the orienting magnetic field is applied. As a result, the green density distribution of the compact becomes generally symmetric in the direction vertical to the direction in which the orienting magnetic field is applied, making possible to reduce the bending of the sintered body. Therefore, the yield of the product can be improved.

Preferably, the correcting yoke is disposed on an upper side of the die if the compact is to be taken out from the upper side of the die, whereas the correcting yoke is disposed on a lower side of the die if the compact is to be taken out from the lower side of the die.

Further, preferably, the die includes an auxiliary yoke: The correcting yoke and the auxiliary yoke respectively have inward side surfaces, and the correcting yoke and the auxiliary yoke are disposed at the time of orientation, with the inward side surfaces respectively made flush with a plane vertical to the direction of the orienting magnetic field. In this case, since the inward side surfaces of the correcting yoke and the auxiliary yoke are respectively made flush at the time of orientation, it becomes easier to symmetrize the magnetic field.

Further, preferably, the correcting yoke is disposed near the die only at the time of orientation. Therefore, the correcting yoke does not interfere with movement of the feeder box and a cleaner.

Preferably, a plurality of the correcting yokes are prepared, and the apparatus further comprises a connecting member for connection of the plurality of correcting yokes with each other. In this case, since the correcting yokes can be fixed with each other by the connecting member, the correcting yokes are rigidly held in position even if a strong magnetic field is generated.

Further, preferably, the correcting yoke is urged toward the die at the time of orientation. Therefore, the correcting yoke can be reliably fitted onto the surface of the die, making more possible to symmetrize the magnetic field in the cavity.

Further, preferably, the correcting yoke and one of the first and second punches disposed on the side where the correcting yoke is disposed are supported by a same supporting member. In this case, for example, the two members can be moved vertically by a single means, leading to a simpler constitution.

Preferably, the correcting yoke and the die are formed integrally with each other. In this case, the constitution of the apparatus can be simplified.

The above objects, other objects, characteristics, aspects and advantages of the present invention will become clearer from the following description of embodiments to be presented with reference to the accompanying drawings.

BRIEF DESCRIPTION OF THE DRAWINGS

FIG. 3A is a perspective view of a primary portion showing the lower surface of the upper cylinder attached with an upper punch, whereas

DETAILED DESCRIPTION OF THE PREFERRED EMBODIMENTS

Embodiments of the present invention will be described here below with reference to the attached drawings.

Figure 1:
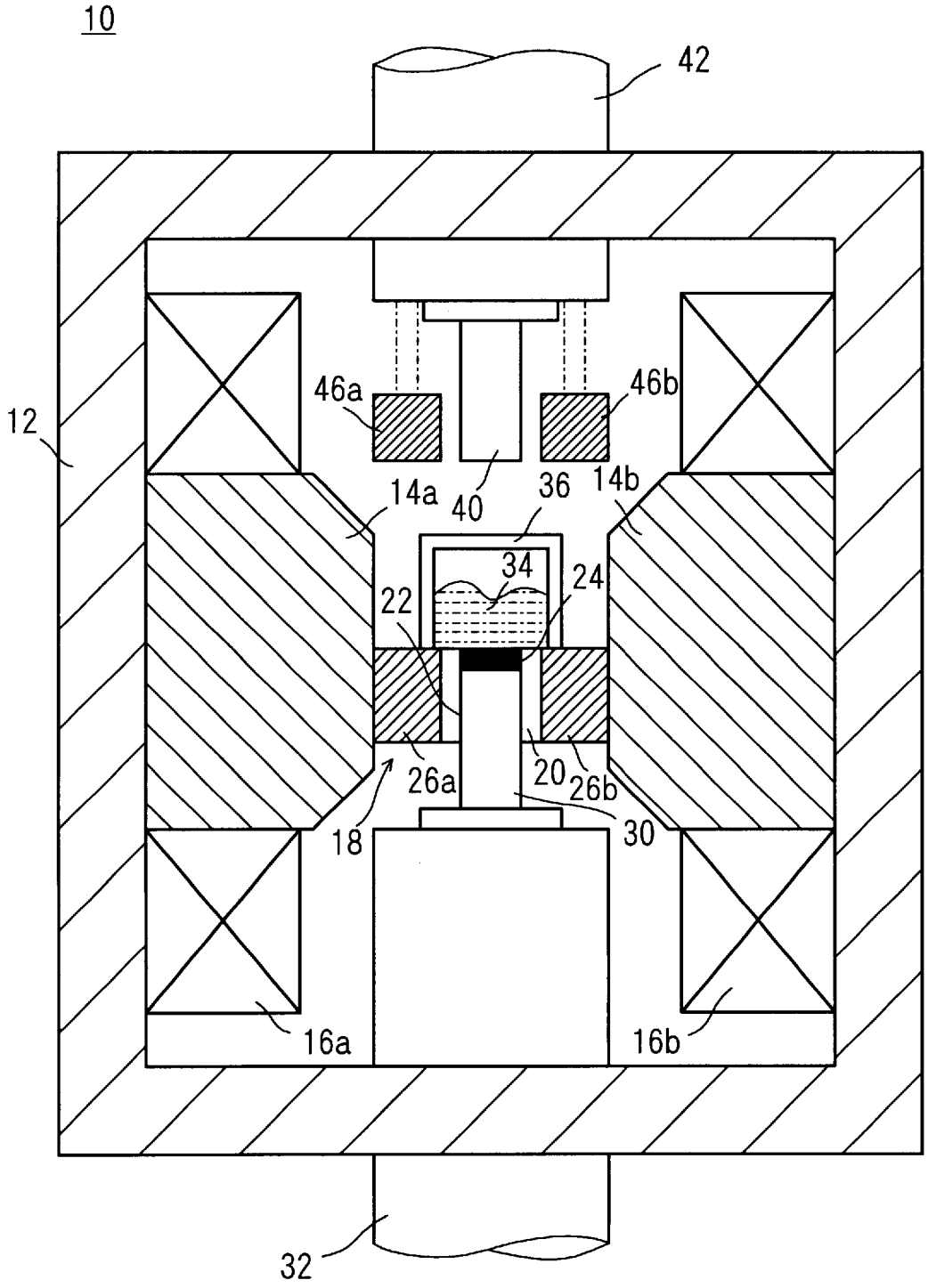
FIG. 1 is a sectional front view schematically showing an embodiment of the present invention.

Referring now to FIG. 1, a rare-earth alloy powder pressing apparatus 10 as an embodiment of the present invention comprises a frame 12 like a cage made of a magnetic material. On inner side surfaces of the frame 12, a pair of pole pieces 14*a* and 14*b* is formed to face each other. The pole pieces 14*a*, 14*b* are surrounded by coils 16*a*, 16*b* respectively. By applying electricity to the coils 16*a*, 16*b*, magnetic flux passing in the frame 12 is generated, and magnetic flux is gathered toward cavities 24 (to be described later) by the pole pieces 14*a*, 14*b*. The pole pieces 14*a*, 14*b* are made of permendur for example.

A die 18 is disposed between the pole pieces 14*a* and 14*b*. As shown also in FIG. 2, the die 18 includes a die main body 20 made of a nonmagnetic material or a magnetic material with low saturation magnetization disposed between the pole pieces 14*a* and 14*b*. The die 18 is preferably made of a hard alloy such as tungsten carbide for superb strength. The die main body 20 is formed with a plurality (specifically five, according to the present embodiment) of through holes 22 in a vertical direction. The cavities 24 are formed in the through holes 22 by the die main body 20 and a lower punch 30 (to be described later). The die main body 20 is flanked by auxiliary yokes 26*a*, 26*b* disposed between the pole pieces 14*a*, 14*b*. The auxiliary yokes 26*a*, 26*b* concentrate the magnetic flux from the pole pieces 14*a*, 14*b* in the cavities 24, enhancing the orientation of compacts being formed in the cavities 24. The auxiliary yokes 26*a*, 26*b* are made of a magnetic material with high saturation magnetization such as carbon steel or permendur.

Further, there are disposed plate members 28*a*, 28*b* flanking the die main body 20 and the auxiliary yokes 26*a*, 26*b*, in a direction vertical to a direction of orientation. It should be noted here that the die main body 20, the auxiliary yokes 26*a*, 26*b* and the plate members 28*a*, 28*b* have upper surfaces respectively in a same plane in order for a feeder box 36 (to be described later) to move smoothly.

Figure 2:
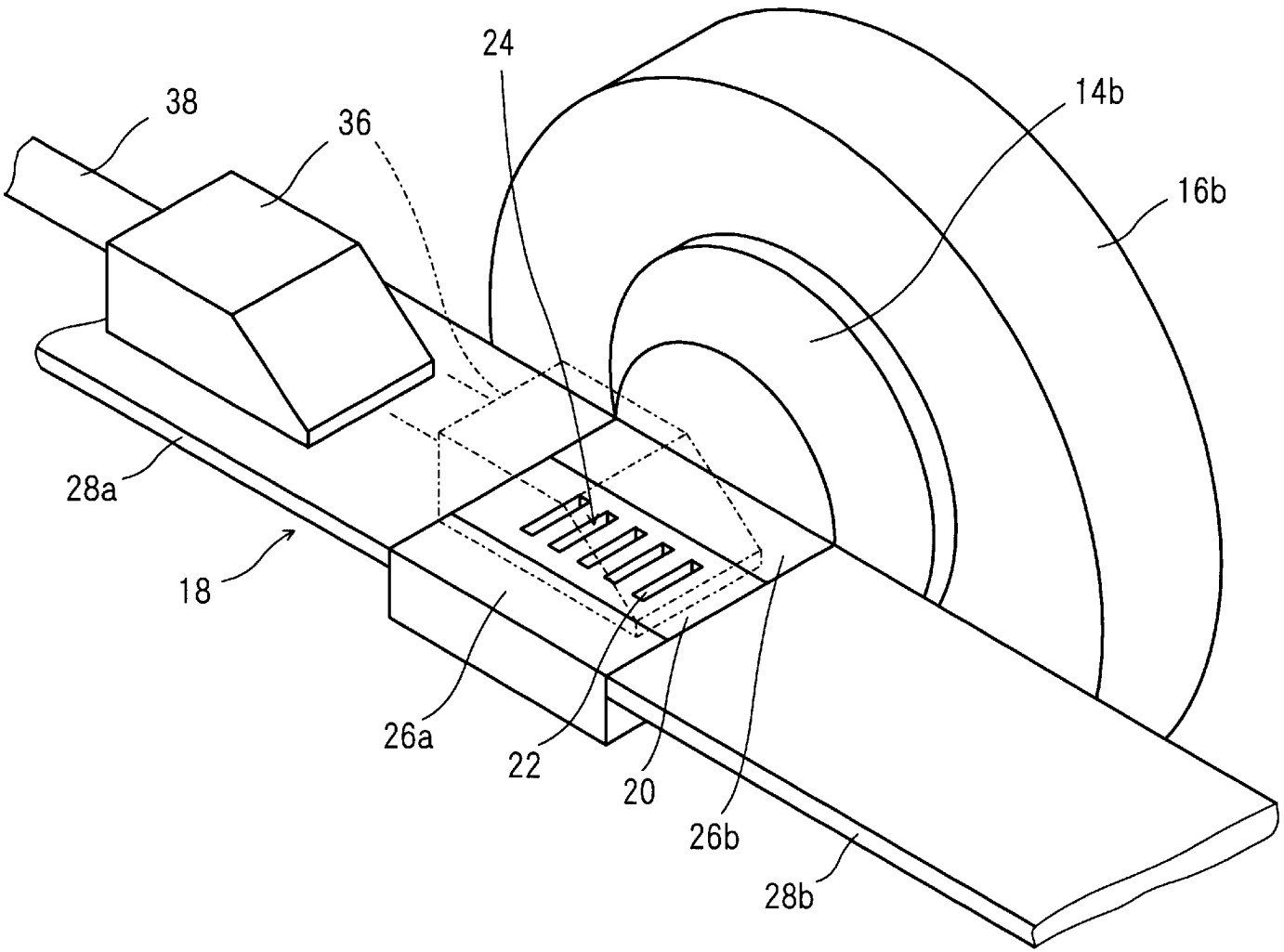
FIG. 2 is a perspective view showing a region including an upper surface of a die.

Returning to FIG. 1, inside the frame 12, a lower punch 30 is inserted from below into the through holes 22 of the die 18. The lower punch 30 is mounted to an upper surface of a lower cylinder 32. Therefore, the lower punch 30 is vertically movable by the lower cylinder 32. Further, a feeder box 36 containing an alloy powder 34 made of a rare-earth alloy is provided on the die 18. As shown in FIG. 2, the feeder box 36 is attached with a driving rod 38. The driving rod 38 is connected to an unillustrated electric motor or a cylinder, etc. Therefore, the feeder box 36 is horizontally slid on the die 18 by the electric motor or cylinder, etc. The alloy powder 34 in the feeder box 36 contacts the upper surface of the die 18. When the feeder box 36 comes above the cavities 24, the alloy powder 34 in the feeder box 36 falls into the cavities 24 to feed.

The alloy powder 34 used herein is obtained in the following method for example:

Specifically, an ingot is made using a strip cast process as disclosed in the U.S. Pat. No. 5,383,978 as a quenching method.

More specifically, an alloy manufactured by a known method and having a composition comprising 30% Nd, 1.0% B, 1.2% Dy, 0.2% Al, 0.9% Co (by weight) with the rest of ingredient being Fe and unavoidable impurities is melted by a high-frequency melting process into a molten. The molten is maintained at 1,350° C., and then quenched on a single roll. Cooling conditions at this time include a roll peripheral speed of about 1 m/s, a cooling rate of 500° C./sec, and a sub-cooling of 200° C. The above quenching process yields a mass of flaky alloy having a thickness of about 0.3 mm. It should be noted here that the cooling rate in the quenching method may be $10^{2°}$ C./sec~$10^{4°}$ C./sec., and the alloy may have such a composition as disclosed in the U.S. Pat. Nos. 4,770,723 and 4,792,368.

The obtained alloy flake is coarsely pulverized by a hydrogen occlusion method, and then finely milled into an alloy powder 34 having an average grain diameter (median diameter) of 3.5 μm by a jet mill in a nitrogen atmosphere.

The alloy powder 34 as above is added with a lubricant for improved orientation and compression. In this case, fatty acid ester is used as the lubricant, and a petroleum solvent is used as a solvent, for example. The fatty acid ester diluted with the petroleum solvent is added by the amount of 0.3 weight % (lubricant base) of the alloy powder 34, and mixed, coating particle surface of the alloy powder 34 with the lubricant.

Further, inside the frame 12, an upper punch 40 to be inserted from above into the through holes 22 of the die main body 20 is disposed. The upper punch 40 is mounted to a lower surface of an upper cylinder 42 by screws for example. Therefore, the upper punch 40 is vertically movable in reciprocation by the upper cylinder 42. The upper punch 40 and the lower punch 30 are made of a nonmagnetic hard alloy such as tungsten carbide for superb strength.

Figure 3A:
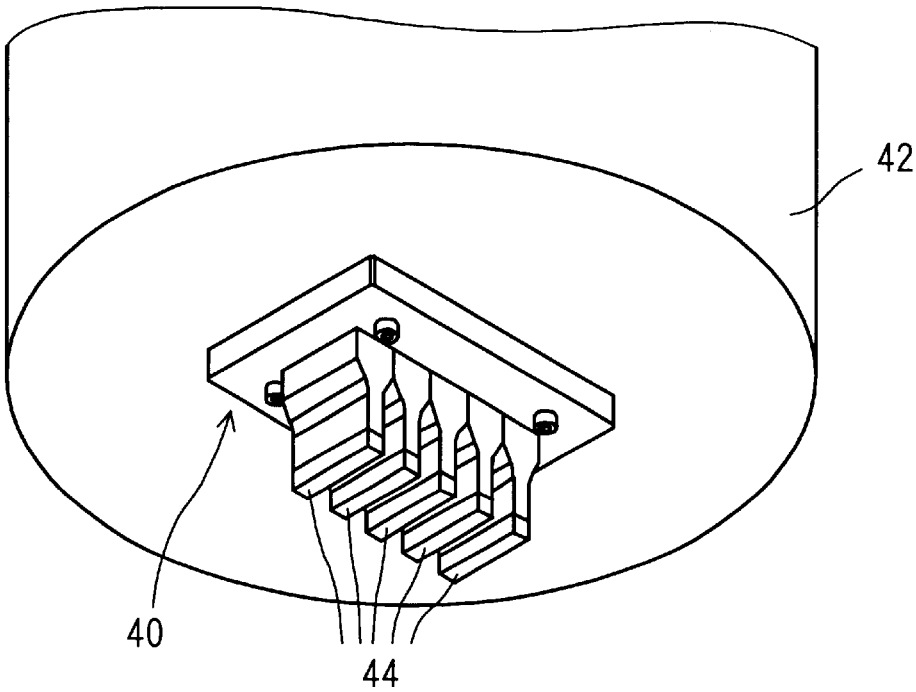

As shown in FIG. 3A, the upper punch 40 includes a plurality (specifically five, according to the present embodiment) of punch main bodies 44 for mating with respective through holes 22. Therefore, the plurality of compacts can be pressed in a single pressing operation by the rare-earth alloy powder pressing apparatus 10.

Figure 3B:
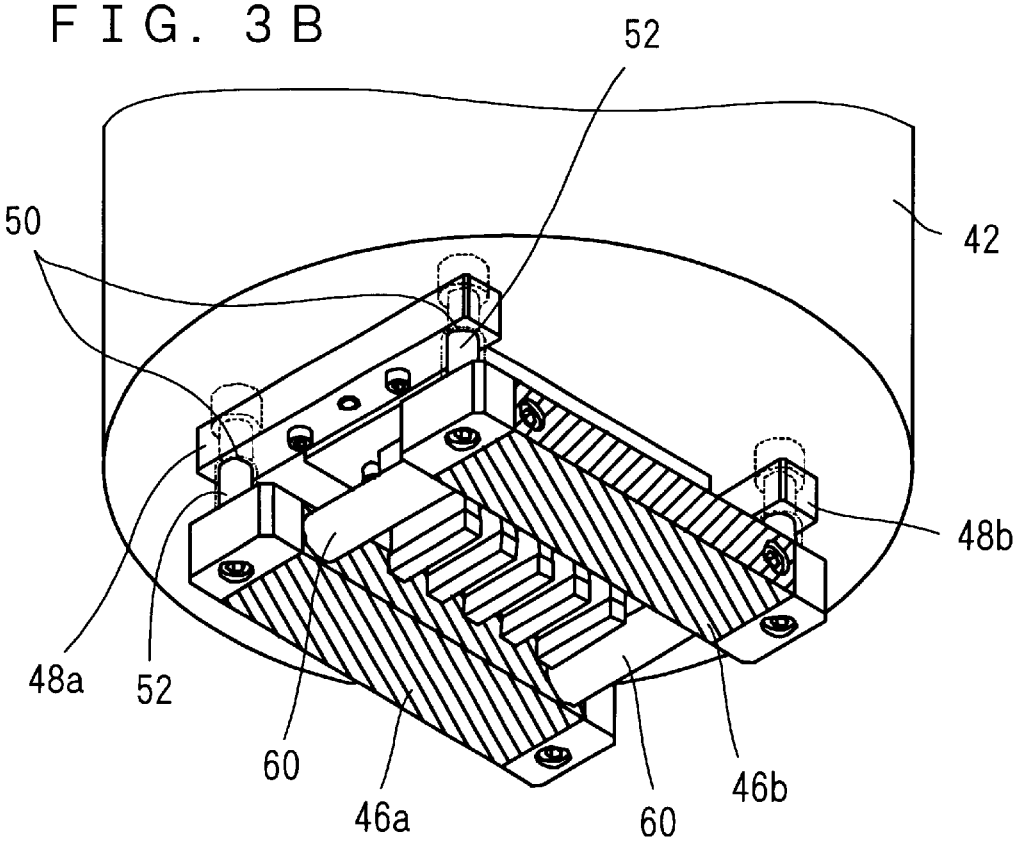
FIG. 3B is a perspective view of a primary portion showing the lower surface further attached with correcting yokes.

Further, as shown in FIG. 3B, the lower surface of the upper cylinder 42 is disposed with correcting yokes 46*a*, 46*b* vertically movable in reciprocation and flanking the upper punch 40.

Figure 4A:
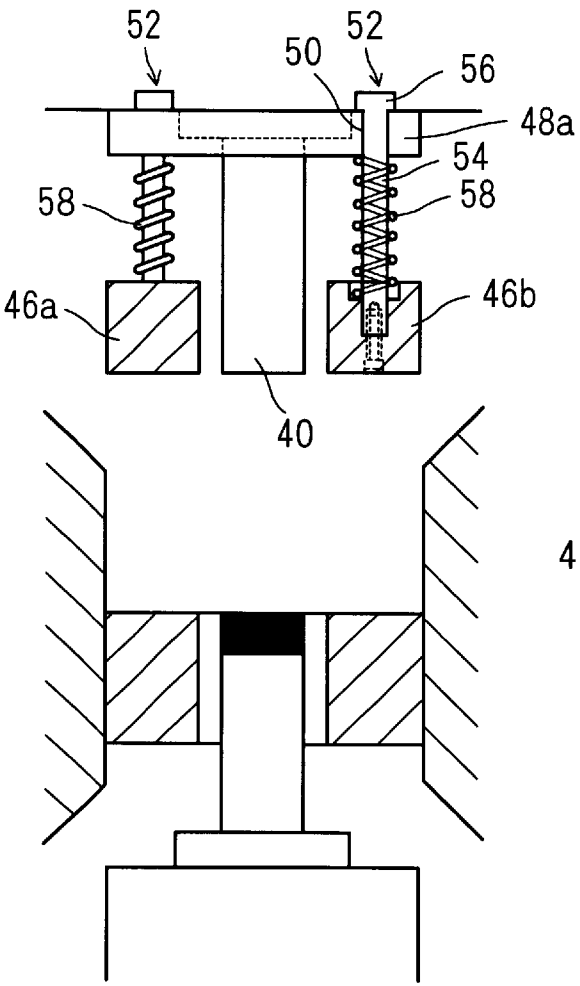
FIG. 4A~FIG. 4C are schematic diagrams for description of a primary portion of the embodiment shown in FIG. 1.

As understood also from FIG. 4A, the lower surface of the upper cylinder 42 is formed with supporting members 48*a*, 48*b* each like a square bar. Each of the supporting members 48*a*, 48*b* has two end portions each formed with a through hole 50. The through hole 50 is inserted by a slide guide 52. The slide guide 52 includes a cylindrical guide main body 54, and a guide head 56 made at an upper end of the cylindrical guide main body 54 and larger than the through hole 50. The guide main body 54 is attached with a compressed coil spring 58. The guide head 56 limits the slide guide 52 from moving down.

Figure 4B:
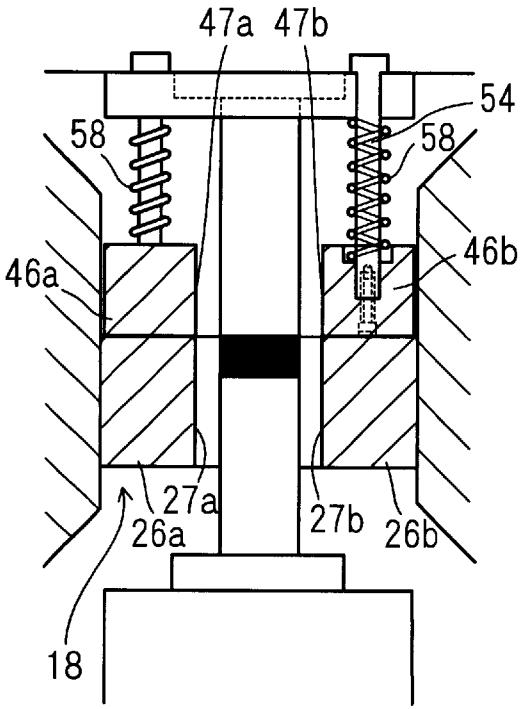
Figure 4C:
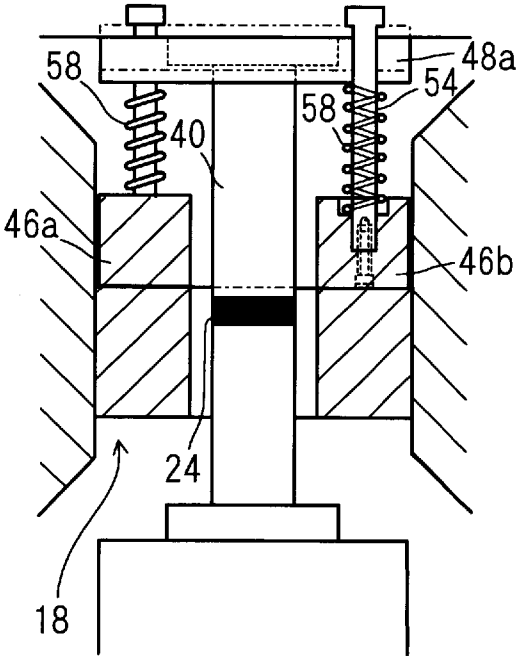

The lower surface of the upper cylinder 42 has recesses (not illustrated) for accepting respective guide heads 56. The supporting members 48*a*, 48*b* attached with the slide guides 52 are mounted to the lower surface of the upper cylinder 42. The correcting yokes 46*a*, 46*b* are attached to tip portions of the slide guides 52. When orienting, as shown in FIG. 4B, the compressed coil springs 58 attached to the guide main bodies 54 urge the correcting yokes 46*a*, 46*b* downwardly, i.e. toward the auxiliary yokes 26*a*, 26*b* respectively. At this time, an inward side surface 47*a* of the correcting yoke 46*a* and an inward side surface 27*a* of the auxiliary yoke 26*a* become flush with each other, whereas the inward side surface 47*b* of the correcting yoke 46*b* and the inward side surface 27*b* of the auxiliary yoke 26*b* become flush with each other. When pressing, as shown in FIG. 4C, the upper punch 40 is lowered while the lower punch 30 is raised, thereby compressing alloy powder 34 in the cavity 24 from the vertical directions. Further, as shown in FIG. 3B, the correcting yokes 46*a*, 46*b* are connected to each other by cylindrical connecting members 60. Thus, the correcting yokes 46*a*, 46*b* are fixed rigidly to each other in a strong magnetic field such as 0.8 MA/m.

It should be noted here that the members shown in FIG. 3A and FIG. 3B other than the correcting yokes 46*a*, 46*b* are all made of a non-magnetic material such as SUS304 so as not to affect the orienting magnetic field. The correcting yokes 46*a*, 46*b* are made of a strong magnetic material such as carbon steel or permendur. If made of the same material as that of the auxiliary yokes 26*a*, 26*b*, it becomes easier to make the magnetic field intensity uniform in the vertical direction.

Now, an operation of the rare-earth alloy powder pressing apparatus 10 as described above will be described with reference to FIG. 5A~FIG. 5G.

Figure 5A:
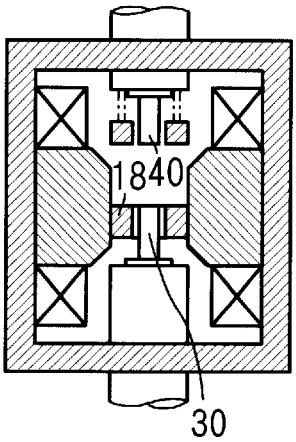
FIG. 5A~FIG. 5G are schematic diagrams showing a sequence of an operation of the embodiment shown in FIG. 1.

First, the rare-earth alloy powder pressing apparatus 10 is in a state in which a previous cycle of the pressing operation is completed. Specifically, as shown in FIG. 5A, the upper surface of the lower punch 30 is flush with the upper surface of the die 18 while the upper punch 40 stays at an end of its upstroke.

Figure 5B:
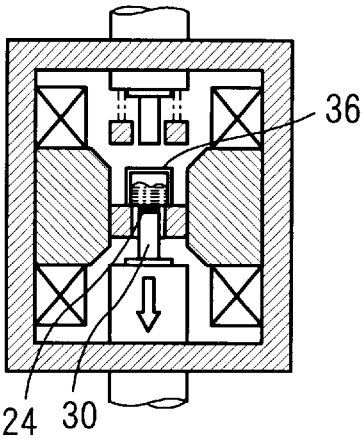

Then, as shown in FIG. 5B, the feeder box 36 is slid onto the lower punch 30, i.e. above the through hole 22. Thereafter, the lower punch 30 is lowered, allowing the alloy powder 34 to be fed into the cavity 24 formed in an upper portion of the through hole 22. When the alloy powder 34 has been fed, the feeder box 36 withdraws, with its lower surface wiping the alloy powder 34.

Figure 5C:
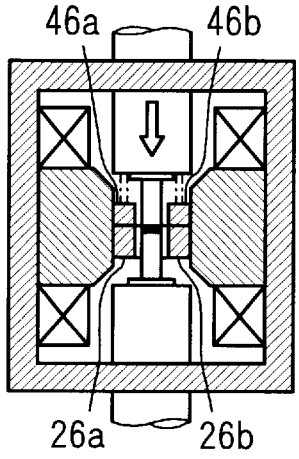
Figure 5D:
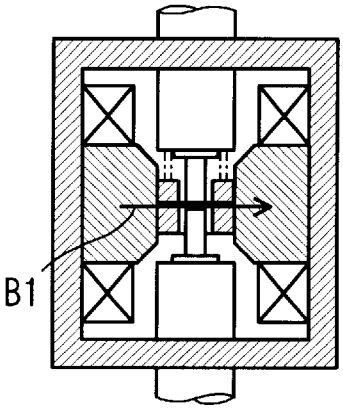
Figure 5E:
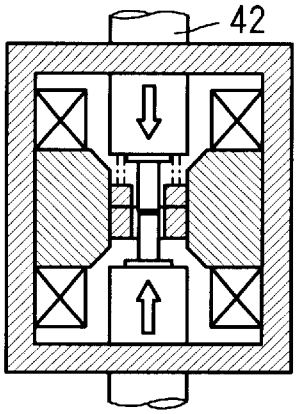

Then, as shown in FIG. 5C, the upper punch 40 and the correcting yokes 46*a*, 46*b* are lowered, upper openings of the cavity 24 is closed by the upper punch 40, and the correcting yokes 46*a*, 46*b* are urged by the compressed coil springs 58 against the auxiliary yokes 26*a*, 26*b* of the die 18 respectively. Then, the orienting magnetic field is applied as shown by an arrow B1 in FIG. 5D. At this time, the cavity 24 is applied with a strong magnetic field of 0.8 MA/m. Thereafter, as shown in FIG. 5E, the upper punch 40 is further lowered, and the lower punch 30 is further raised to compress the alloy powder 34 in the cavity 24 between the upper punch 40 and the lower punch 30. Simultaneously during this step, the supporting members 48*a*, 48*b* formed on the lower surface of the upper cylinder 42 is lowered, allowing the compressed coil springs 58 to further urge the correcting yokes 46*a*, 46*b* against the auxiliary yokes 26*a*, 26*b* respectively.

Figure 5F:
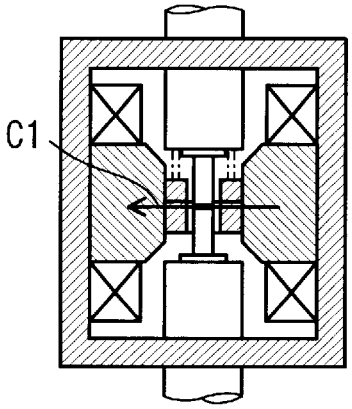
Figure 5G:
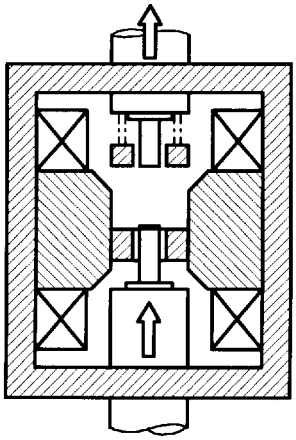

When the pressing step is complete, as shown by an arrow C1 in FIG. 5F, a reverse magnetic field having an opposite polarity to the orienting magnetic field is applied to demagnetize the compact. Thereafter, as shown in FIG. 5G, the upper punch 40 is raised and the lower punch 30 is raised so that the compact is pushed up to be taken out from the through hole 22 of the die main body 20, completing a cycle of pressing operation.

Figure 6:
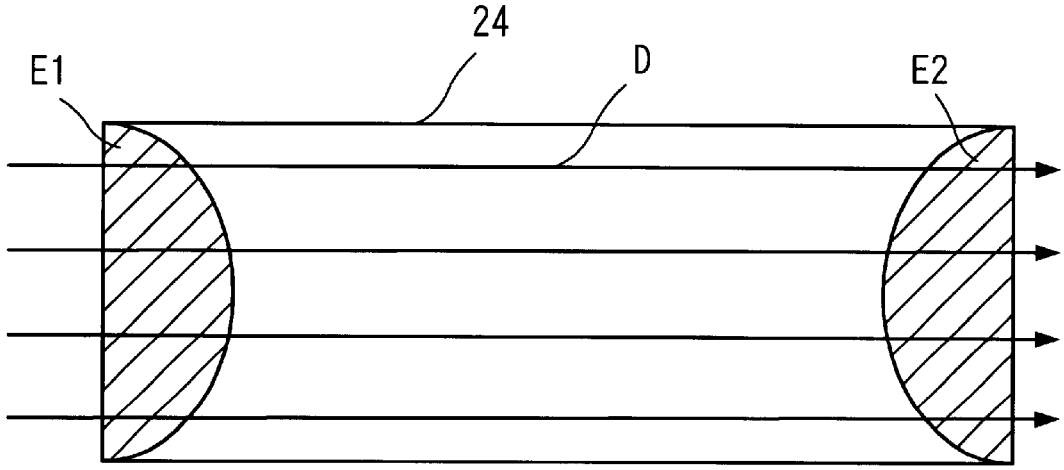
FIG. 6 is a conceptual diagram illustrating a state inside a cavity during orientation by the embodiment shown in FIG. 1.

According to the rare-earth alloy powder pressing apparatus 10 as described above, by disposing the correcting yokes 46*a*, 46*b* onto the auxiliary yokes 26*a*, 26*b* of the die 18 respectively, the cavities 24 can be placed virtually at the center between the yokes when applying the orienting magnetic field. Therefore, as shown in FIG. 6, there are formed regions E1, E2 each having a strong magnetic flux density generally in a vertical symmetrically with respect to the cavities, forming a magnetic flux D generally in vertical symmetry with respect to the cavity 24. As a result, green density of the compact becomes generally symmetric in a direction of thickness of the compact, i.e. in a direction vertical to the direction of the orienting magnetic field, making possible to reduce bending and cracking at the time of sintering, thereby improving yield of the product.

Further, when orienting, it is possible to make flush the inward side surface 27*a* of the auxiliary yoke 26*a* with the inward side surface 47*a* of the correcting yoke 46*b*, and the inward side surface 27*b* of the auxiliary yoke 26*b* with the inward side surface 47*b* of the correcting yoke 46*b*. Further, the correcting yokes 46*a*, 46*b* can be reliably and tightly pressed against the surface of the die 18 by using the compressed coil springs 58 to urge the correcting yokes 46*a*, 46*b* against the die 18. Therefore, the symmetry of the magnetic field within the cavity 24 can be formed more reliably.

Further, since the correcting yokes 46*a*, 46*b* are disposed on the die 18 only at the time of orientation, the correcting yokes 46*a*, 46*b* do not interfere with movement of the feeder box 36 and a cleaner (not illustrated).

Further, since the correcting yokes 46*a*, 46*b* can be fixed to each other by the connecting members 60, the correcting yokes 46*a*, 46*b* are rigidly held in position without being moved by the orienting magnetic field such as 0.8 MA/m. Therefore, a desired orienting magnetic field can be formed.

Still further, the upper punch 40 and the auxiliary yokes 46*a*, 46*b* are supported by a same supporting member, i.e. the upper cylinder 42. Thus, constitution of the rare-earth alloy powder pressing apparatus 10 can be simplified.

Further, since the alloy powder 34 is supplied by the wiping action by the feeder box 36 according to the rare-earth alloy powder pressing apparatus 10, the pressing cycle can be shortened. The compact manufactured as above is then placed on a sintering plate and then into a sintering pack with the sintering plate, and thereafter sintered at a temperature of 1000° C.~1200° C. for an hour in an argon atmosphere, to become a rare-earth magnet.

Figure 14:
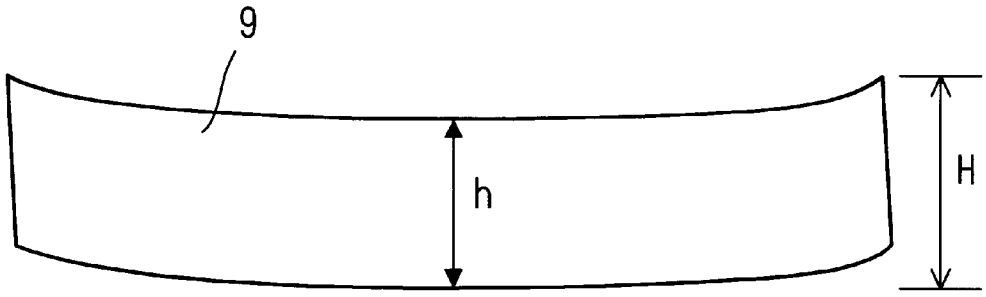
FIG. 14 is an illustration showing a sintered body obtained by the related art.

Now, result of an experiment will be described, in which sintered bodies each having a square cross section with a side of 12.5 mm and a length of 52 mm were manufactured. An amount of distortion for evaluation of the experiment result was obtained by averaging the amount of distortion of twenty-five sintered bodies. The amount of distortion was defined as H—h as shown in FIG. 14. The result of experiment shows that the amount of distortion was 0.312 mm when the rare-earth alloy powder pressing apparatus 1 was used. On the other hand, the amount of distortion was improved to 0.111 mm when the rare-earth alloy powder pressing apparatus 10 was used. Since the distortion of the sintered body can be reduced as exemplified above, an amount of margin to be taken for machining purpose can be decreased, making possible to cut down on raw material cost. Further, it becomes possible to reduce the number of machining steps, making possible to reduce a rate of rejected products due to inferior machining.

Figure 7:
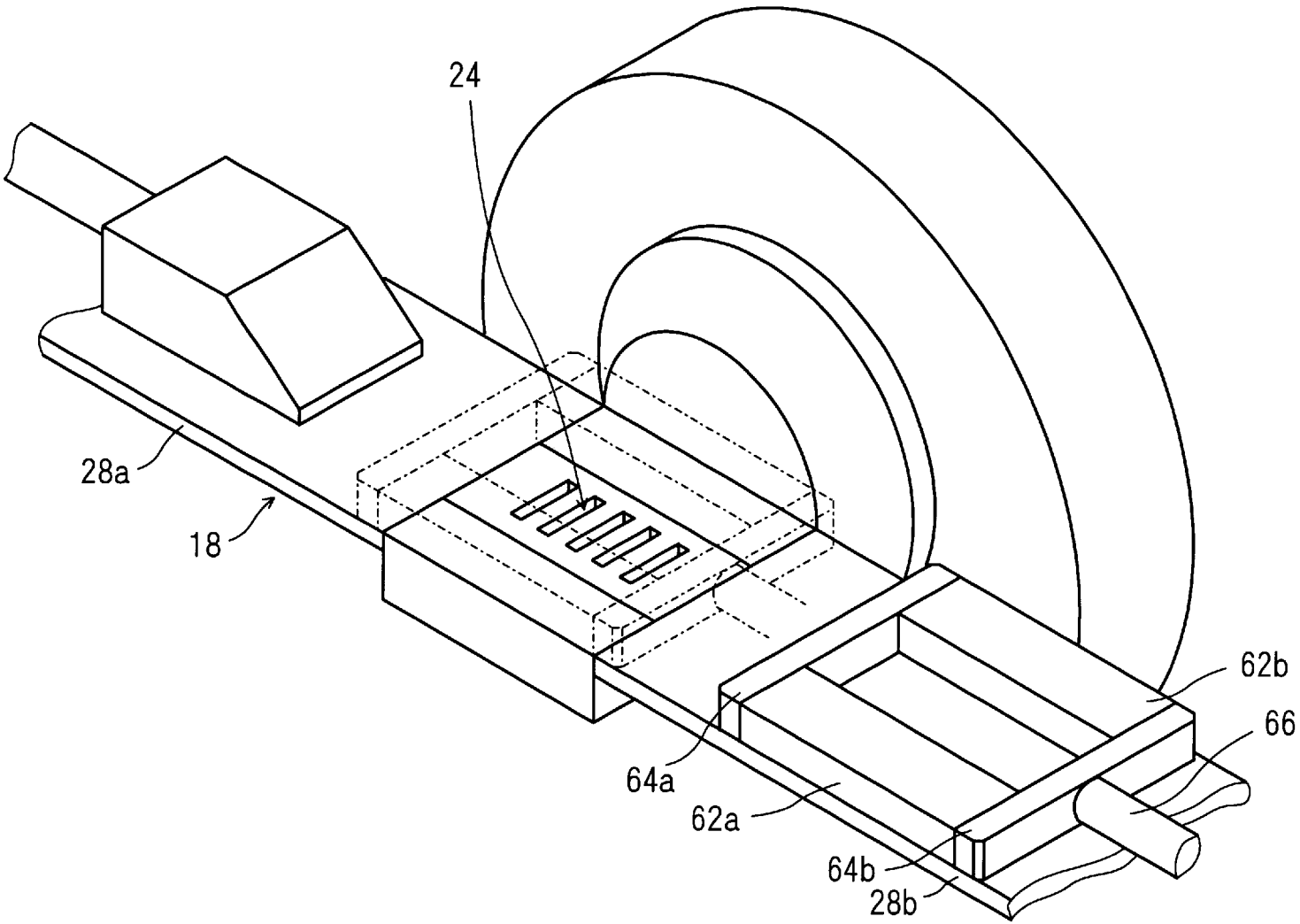
FIG. 7 is a perspective view showing a variation of the correcting yoke.

Alternatively, the correcting yokes can be formed as shown in FIG. 7.

Specifically, correcting yokes 62*a*, 62*b* shown in FIG. 7 are disposed on the upper surface of the die 18. Respective end portions of the correcting yokes 62*a*, 62*b* are interconnected by connecting members 64*a*, 64*b* , and the connecting member 64*b* is connected to a driving rod 66. The driving rod 66 is connected to an unillustrated electric motor or a cylinder, etc. Therefore, the correcting yokes 62*a*, 62*b* are slid on the upper surface of the die 18 by the electric motor or the cylinder etc, and at the time of orienting, the correcting yokes 62*a*, 62*b* are moved to a vicinity of the cavities 24 as indicated by dotted lines.

Figure 8:
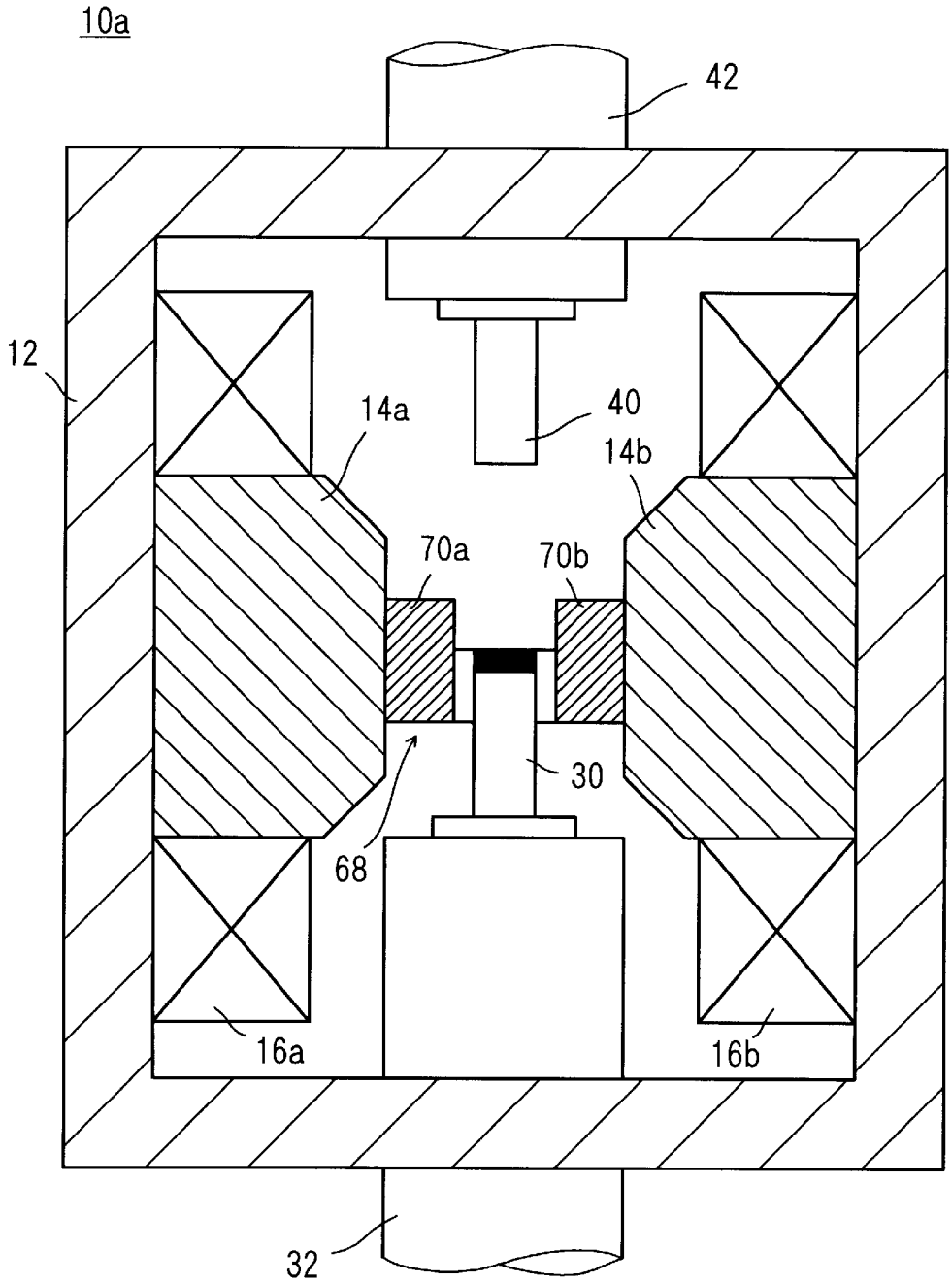
FIG. 8 is a sectional front view schematically showing another embodiment of the present invention.
Figure 9:
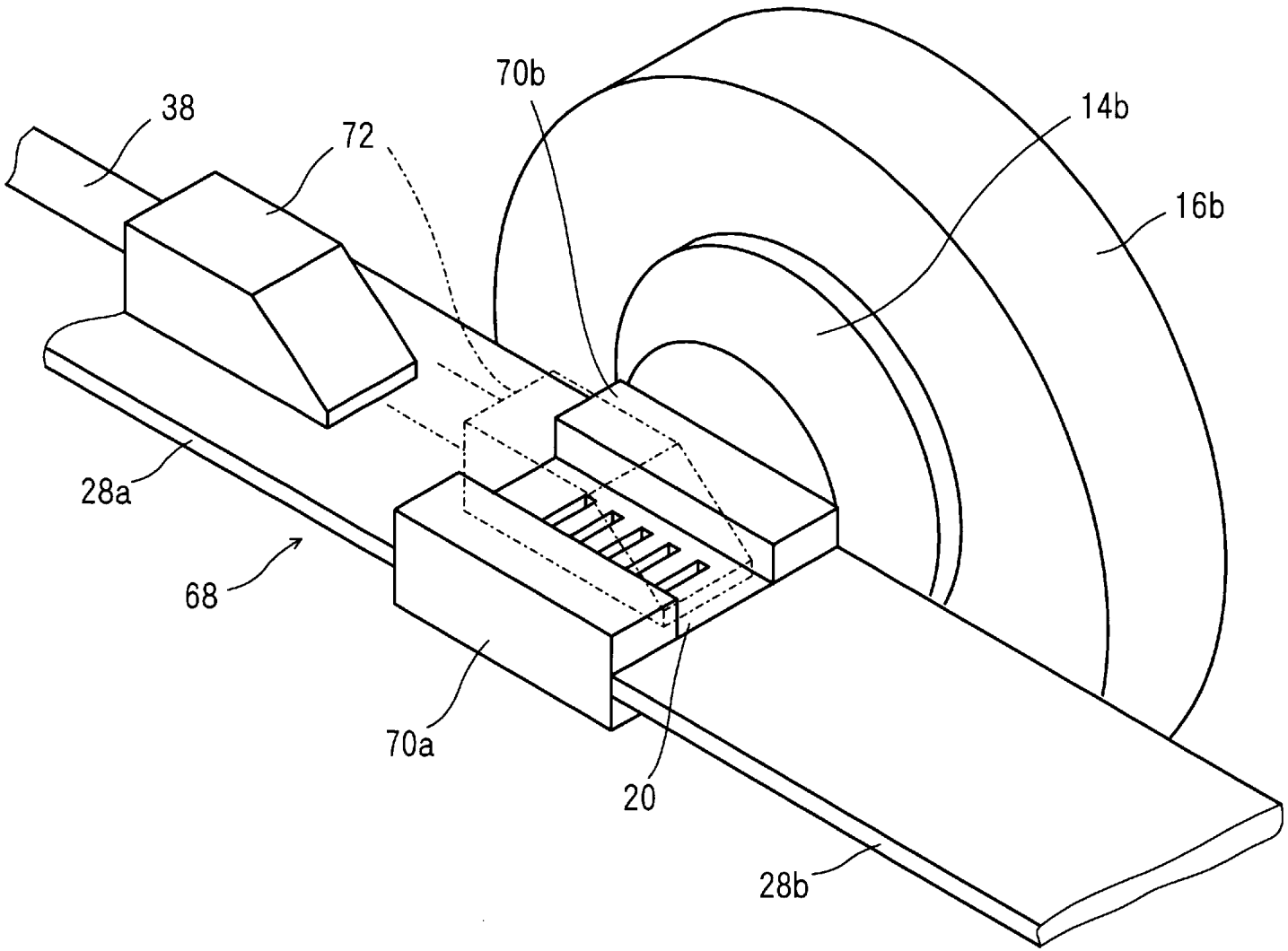
FIG. 9 is a perspective view showing a primary portion of the embodiment shown in FIG. 8.

Further alternatively, a rare-earth alloy powder pressing apparatus 10*a* shown in FIG. 8 may be used. As shown in FIG. 9, the rare-earth alloy powder pressing apparatus 10*a* comprises a die 68 including yokes 70*a*, 70*b* each as an integration of the auxiliary yoke and the correcting yoke. Further, a feeder box 72 has a width slightly smaller than a space between the yokes 70*a*, 70*b* so that the feeder box 72 can move through between the yokes 70*a*, 70*b* onto the die main body 20. Other arrangements are the same as in the rare-earth alloy powder pressing apparatus 10, and therefore will not be described in repetition.

According to the rare-earth alloy powder pressing apparatus 10*a*, similar effect as achieved by the rare-earth alloy powder pressing apparatus 10 can be obtained. In addition, since the integral yokes 70*a*, 70*b* are used, there is no need to move the correcting yokes, making possible to simplify the constitution and operation of the rare-earth alloy powder pressing apparatus 10*a*. Further, since the feeder box 36 can slide on the die 68 without interference, there is no problem in feeding the powder to the cavities 24.

Figure 10:
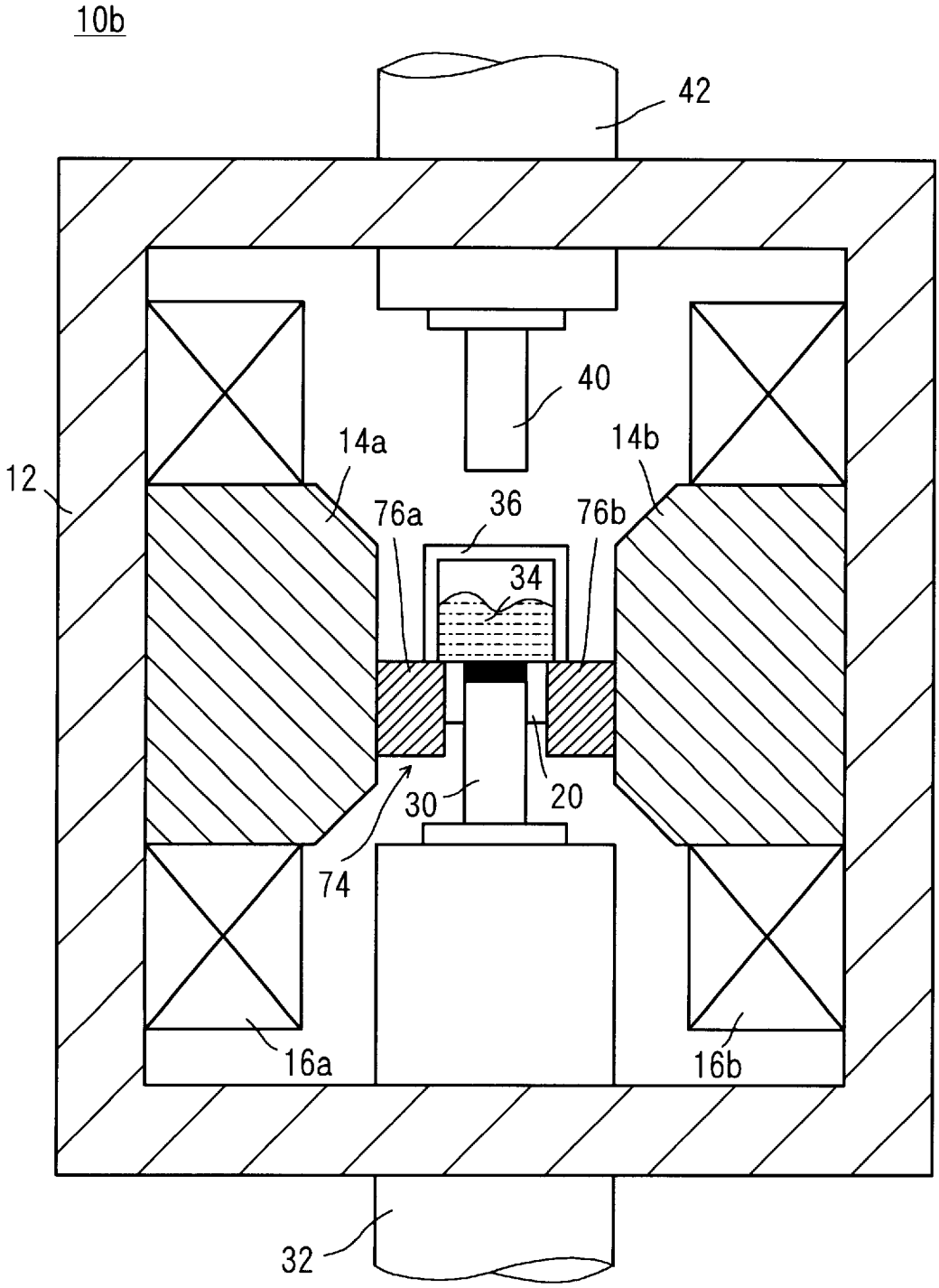
FIG. 10 is a sectional front view schematically showing another embodiment of the present invention.

Further, alternatively, a rare-earth alloy powder pressing apparatus 10*b* as shown in FIG. 10 may be used.

The rare-earth alloy powder pressing apparatus 10*b* is constituted so that the compact is taken out from a lower side of the die 74. The die 74 of the rare-earth alloy powder pressing apparatus 10*b* includes yokes 76*a*, 76*b* each as an integration of the auxiliary yoke and the correcting yoke. The yokes 76*a*, 76*b* are formed to project further downwardly than a lower surface of the die main body 20 and a cavity is formed lower than that of the pressing apparatus 10. Other arrangements are the same as in the rare-earth alloy powder pressing apparatus 10, and therefore will not be described in repetition.

Now, an operation of the rare-earth alloy powder pressing apparatus 10*b* will be outlined with reference to FIG. 11A~FIG. 11I.

Figure 11A:
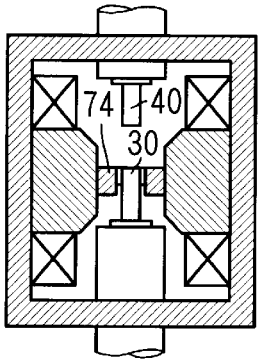
FIG. 11A~FIG. 11I are schematic diagrams showing a sequence of an operation of the embodiment shown in FIG. 10.

First, as shown in FIG. 11A, the upper surface of the die 74 is flush with the upper surface of the lower punch 30, whereas the upper punch 40 is at an end of its upstroke.

Figure 11B:
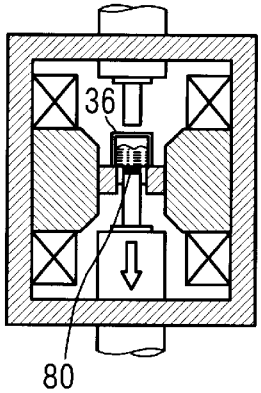

Then, as shown in FIG. 11B, the feeder box 36 is slid onto the lower punch 30, i.e. above the through hole 22. The lower punch 30 is lowered to allow the alloy powder 34 to be fed into the cavity 80 formed in an upper portion of the through hole 22. When the feeding of the alloy powder 34 is complete, the feeder box 36 is withdrawn.

Figure 11C:
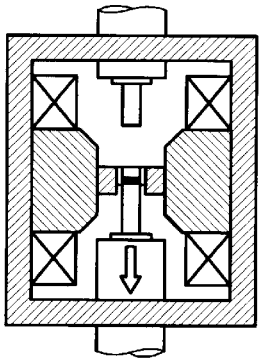
Figure 11D:
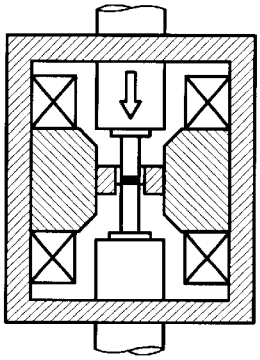
Figure 11E:
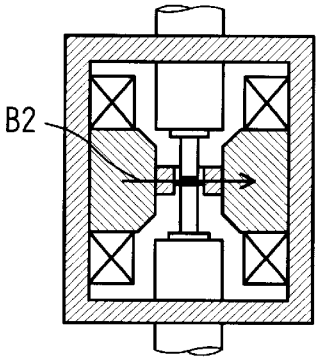
Figure 11F:
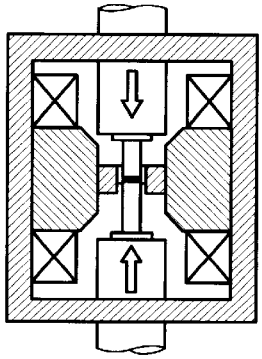

Then, the lower punch 30 is further lowered as shown in FIG. 11C, and the upper punch 40 is lowered as shown in FIG. 11D to close the upper opening of the cavity 80, thereupon the orienting magnetic field is applied as indicated by an arrow B2 in FIG. 11E. Thereafter, as shown in FIG. 11F, the upper punch 40 is further lowered whereas the lower punch 30 is raised to compress the alloy powder 34 in the cavity 80 between the upper punch 40 and the lower punch 30.

Figure 11G:
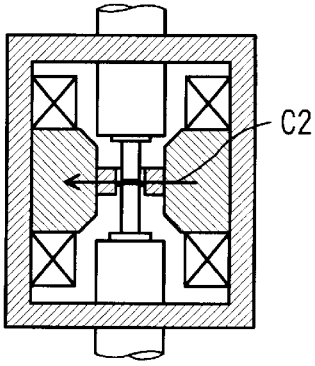
Figure 11H:
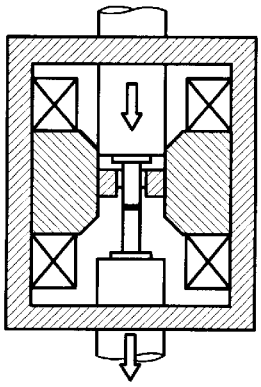
Figure 11I:
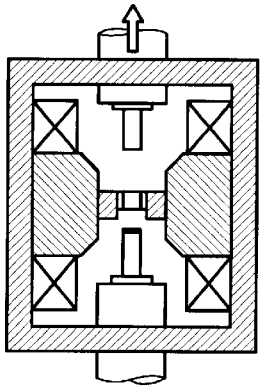
Figure 12:
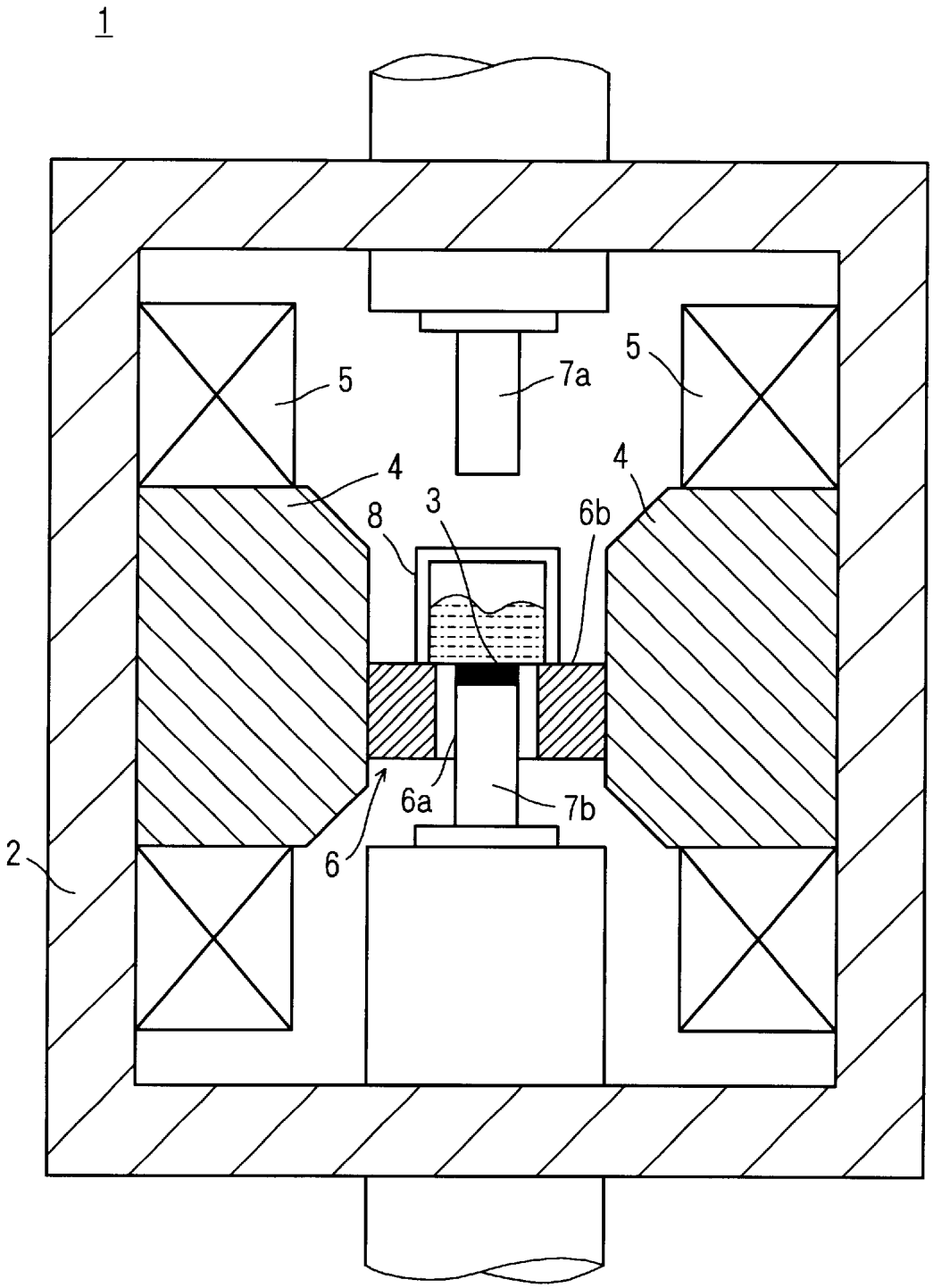
FIG. 12 is a sectional front view showing a related art.
Figure 13:
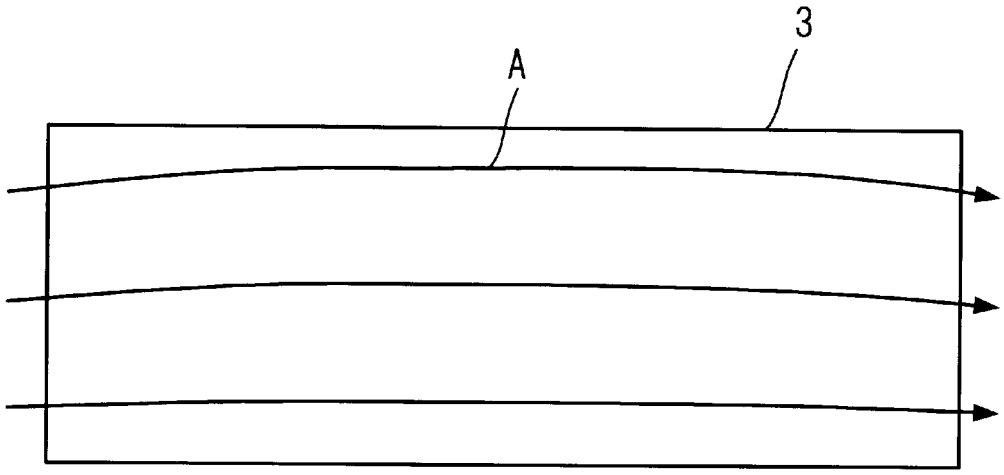
FIG. 13 is a conceptual diagram illustrating a state inside a cavity in the related art.

When the pressing step is complete, as shown by an arrow C2 in FIG. 11G, a reverse magnetic field having an opposite polarity to the orienting magnetic field is applied to demagnetize the compact. Thereafter, as shown in FIG. 11H, the upper punch 40 and the lower punch 30 are lowered, and then as shown in FIG. 11I, the upper punch 40 is raised, and the compact formed on the lower punch 30 is taken out, completing a cycle of pressing operation.

According to the rare-earth alloy powder pressing apparatus 10*b* as described above, similar effect as achieved by the rare-earth alloy powder pressing apparatus 10*a* can be obtained. In addition, since the feeder box 36 is disposed on the die 74 whereas the yokes 76*a*, 76*b* are projected downwardly of the die 74, the size of the feeder box 36 is not limited by the yokes. On the other hand, the yokes 76*a*, 76*b* can be constituted regardless of the size or operation, etc. of the feeder box 36. As a result, it becomes possible to simplify the constitution and operation of the rare-earth alloy powder pressing apparatus 10*b*.

It should be noted here that the above invention is effective if the cavity is formed closer to an end of the through hole of the die.

Further, according to the above embodiment, description is only made for a case in which the compact is taken out from the upper or lower opening. However, the present invention is not limited to this, and can be applicable to a case in which the compact is taken out sidewise for example, and in such a case the correcting yokes are disposed on the side from which the compact is taken out, needless to say.

When orienting, there may be a gap between the auxiliary yoke and the correcting yoke, but the gap should preferably be small.

Further, according to the above embodiment, description is made for a case in which the lower punch 30 is moved vertically. However, the present invention is not limited to this, and the die may be moved vertically for example.

The present invention being thus far described and illustrated in detail, it is obvious that these description and drawings only represent an example of the present invention, and should not be interpreted as limiting the invention. The spirit and scope of the present invention is only limited by words used in the accompanied claims.

What is claimed is:

1. A rare-earth alloy powder pressing apparatus for manufacture of a compact by pressing a rare-earth alloy powder fed in a cavity of a through hole of a die, comprising:

a first punch and a second punch for pressing the rare-earth alloy powder fed in the cavity; and a correcting yoke disposed near the die at a time of orientation, on a side from which the compact is taken out, for correction of a magnetic field in the cavity closer to a symmetry in a direction vertical to a direction of an orienting magnetic field.

2. The apparatus according to claim 1, wherein the die includes an auxiliary yoke, the correcting yoke and the auxiliary yoke respectively having inward side surfaces, the correcting yoke and the auxiliary yoke being disposed at the time of orientation, with the inward side surfaces respectively becoming flush with a plane vertical to the direction of the orienting magnetic field.

3. The apparatus according to claim 1, wherein the correcting yoke is disposed near the die only at the time of orientation.

4. The apparatus according to claim 1, wherein a plurality of the correcting yokes are prepared, the apparatus further comprises a connecting member for connection of the plurality of correcting yokes with each other.

5. The apparatus according to claim 1, further comprising urging means for urging the correcting yoke toward the die.

6. The apparatus according to claim 1, further comprising a supporting member for support of the correcting yoke and one of the first and second punches disposed on the side where the correcting yoke is disposed.

7. The apparatus according to claim 1, wherein the correcting yoke and the die are formed integrally with each other.

8. The apparatus according to claim 1, wherein the through hole of the die is formed in a vertical direction, the compact being taken out from an upper side of the die, the correcting yoke being provided on the upper side of the die.

9. The apparatus according to claim 1, wherein the through hole of the die is formed in a vertical direction, the compact being taken out from a lower side of the die, the correcting yoke being provided on the lower side of the die.

10. A rare-earth alloy powder pressing method for manufacture of a compact by pressing a rare-earth alloy powder fed in a cavity of a through hole of a die, the method comprising:

a first step of feeding the rare-earth alloy powder in the cavity; and a second step of orienting the rare-earth alloy powder, with a correcting yoke disposed near the die, on a side from which the compact is taken out.

11. The method according to claim 10, wherein the second step including a sub-step of disposing the correcting yoke and the auxiliary yoke respectively having inward side surfaces, at a time of orientation, with the inward side surfaces respectively being flush with a plane vertical to the direction of the orienting magnetic field.

12. The method according to claim 10, wherein the second step includes a sub-step of disposing the correcting yoke near the die only at the time of orientation.

13. The method according to claim 10, wherein the second step includes urging of the correcting yoke toward the die at the time of orientation.

14. The method according to claim 10, wherein the correcting yoke and the die are formed integrally with each other.

15. The method according to claim 10, wherein the through hole of the die is formed in a vertical direction, the compact being taken out from an upper side of the die, the correcting yoke being provided on the upper side of the die in the second step.

16. The method according to claim 10, wherein the through hole of the die is formed in a vertical direction, the compact being taken out from a lower side of the die, the correcting yoke being provided on the lower side of the die in the second step.

17. A rare-earth magnet obtained by sintering a compact manufactured by a rare-earth alloy powder pressing method for manufacture of a compact by pressing a rare-earth alloy powder fed in a cavity of a through hole of a die, the method comprising: a first step of feeding the rare-earth alloy powder in the cavity; and a second step of orienting the rare-earth alloy powder, with a correcting yoke disposed near the die, on a side from which the compact is taken out.

18. A rare-earth magnet obtained by sintering a compact manufactured by a rare-earth alloy powder pressing method for manufacture of a compact by pressing a rare-earth alloy powder fed in a cavity of a through hole of a die including at least one auxiliary yoke formed to flank the through hole, the method comprising: a first step of feeding the rare-earth alloy powder in the cavity; and a second step of orienting the rare-earth alloy powder, with a correcting yoke disposed near the die, on a side from which the compact is taken out; the second step including a sub-step of disposing the correcting yoke and the auxiliary yoke respectively having inward side surfaces, at a time of orientation, with the inward side surfaces respectively being flush with a plane vertical to the direction of the orienting magnetic field.

* * * * *